US006375478B1

(12) United States Patent
Kikuchi

(10) Patent No.: US 6,375,478 B1
(45) Date of Patent: Apr. 23, 2002

(54) CONNECTOR WELL FIT WITH PRINTED CIRCUIT BOARD

(75) Inventor: Kazuya Kikuchi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/597,901

(22) Filed: Jun. 19, 2000

(30) Foreign Application Priority Data

Jun. 18, 1999 (JP) ..... 11-171805

(51) Int. Cl.[7] ..... H01R 12/00
(52) U.S. Cl. ..... 439/79; 439/733.1; 439/595
(58) Field of Search ..... 439/79, 80, 607, 439/541.5, 733.1, 595

(56) References Cited

U.S. PATENT DOCUMENTS 4,983,127 A * 1/1991 Kawai et al. ..... 439/79
5,032,085 A * 7/1991 Alwine et al. ..... 439/79
5,226,840 A * 7/1993 Wojtanek ..... 439/733
5,453,016 A * 9/1995 Clark et al. ..... 439/79
5,692,912 A * 12/1997 Nelson et al. ..... 439/79
5,725,386 A * 3/1998 Davis et al. ..... 439/79
5,733,143 A * 3/1998 Ward et al. ..... 439/595
5,743,765 A * 4/1998 Andrews et al. ..... 439/608
5,910,031 A * 6/1999 Goto ..... 439/595
5,984,735 A * 11/1999 Daoud ..... 439/733.1
6,123,586 A * 9/2000 MacDougall ..... 439/701

FOREIGN PATENT DOCUMENTS

JP 2537698 7/1996
JP 2557612 8/1997

* cited by examiner

*Primary Examiner*—Tho D. Ta
(74) *Attorney, Agent, or Firm*—Young & Thompson

(57) ABSTRACT

A connector is composed of a plurality of contacts, a housing and a locator. The plurality of contacts are formed to have nearly L-shaped forms. One end of each of the plurality of contacts is inserted along a contact inserting direction and is fixed in the housing such that the other end of the contact is held along a direction orthogonal to the contact inserting direction. The locator has a plurality of slits in which the other ends of the plurality of contacts are inserted. Also, the locator has a plurality of through-holes consecutive to the plurality of slits such that the other ends of the plurality of contacts penetrate the plurality of through-holes. The locator is mounted on a surface of the housing on which the plurality of contacts are fixed, from a direction orthogonal to the contact inserting direction.

3 Claims, 13 Drawing Sheets

Fig. 11A
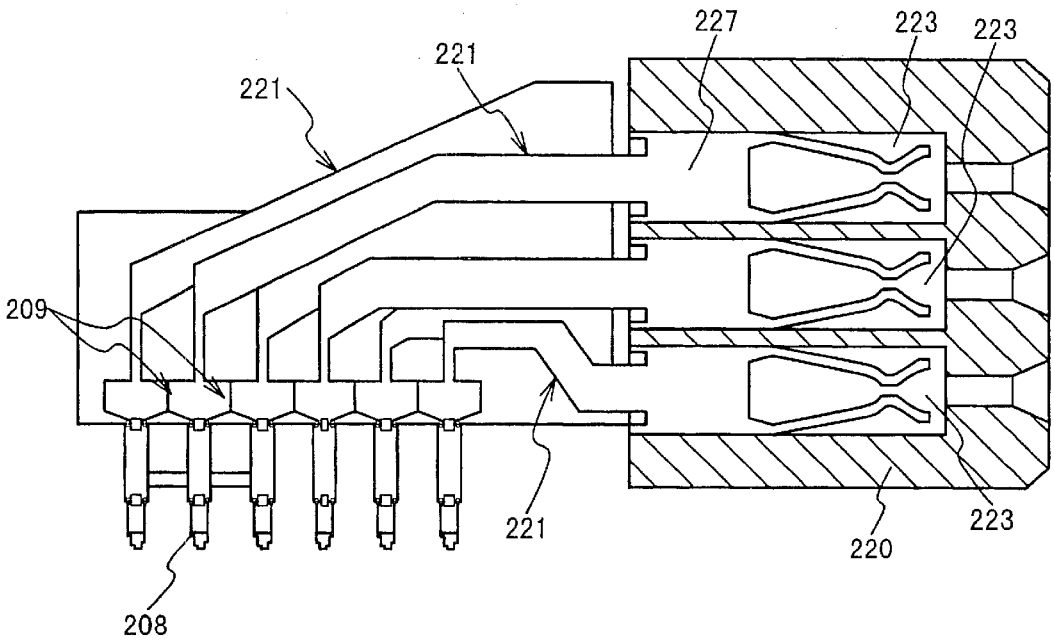
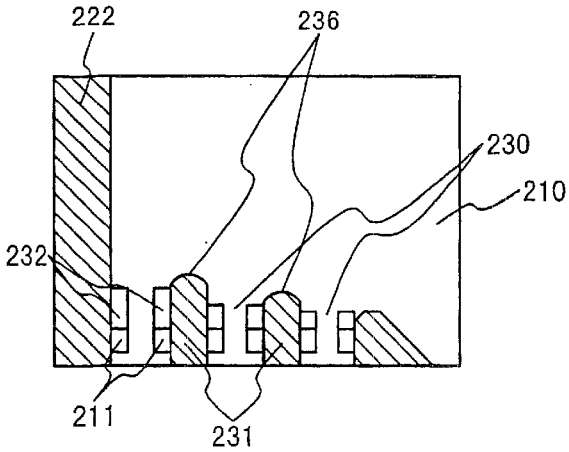
Fig. 11B

Fig. 12A
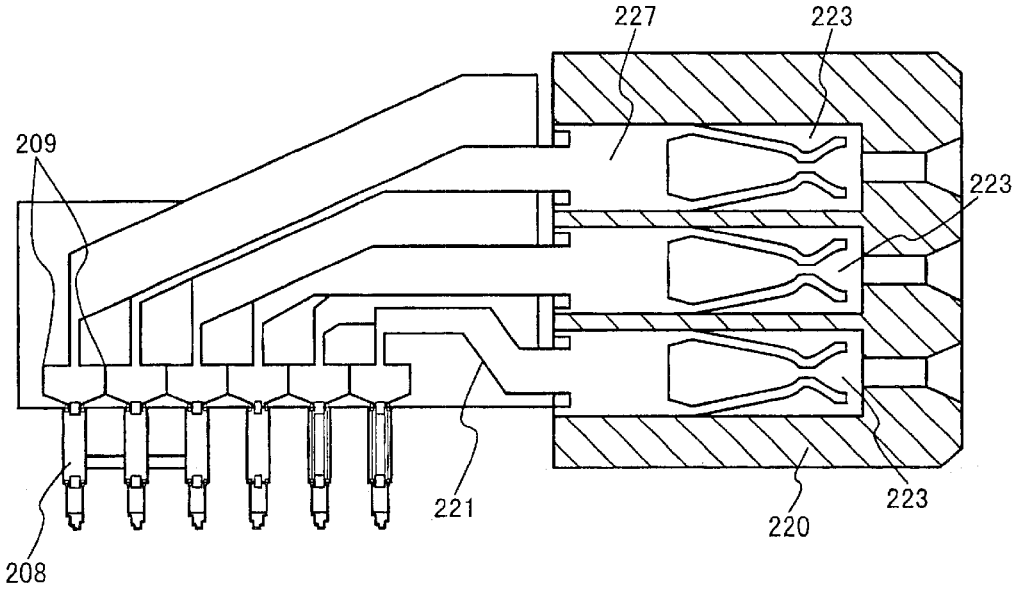
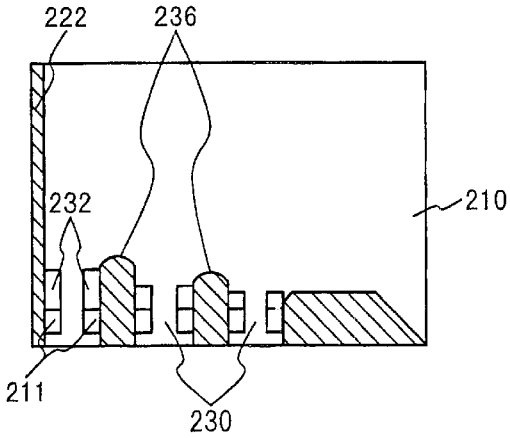
Fig. 12B

CONNECTOR WELL FIT WITH PRINTED CIRCUIT BOARD

BACKGROUND OF THE INVENTION

1. Field of the Invention

The present invention relates to a connector disposed in a printed circuit board. More particularly, the present invention relates to a so-called press-fit type connector fixed by press-fitting into through-holes formed in a printed circuit board.

2. Description of the Related Art

As a conventional press-fit type connector, for example, a structure as shown in FIG. 1 has been known. Referring to FIG. 1, a connector 300 has contacts 301. The plurality of contacts 301 for electric connection are formed by blanking into a nearly L-shape by a press. The contacts 301 are formed in a nearly similar shape. The plurality of contacts 301 are disposed on a same plane, and formed integrally by insert molding to form a contact group 306. A plurality of contact groups 306 are mounted on a print circuit board 305 by press-fitting one end of each contact 301 of each contact group 306 into a housing 303 simply. In this way, to connect and fix this connector 300 electrically to the printed circuit board 305, press-fit portions 304 formed at other end of each contact 301 are press-fitted into the through-holes formed in the printed circuit board 305. At that time, the upper planes 307 of the insert-molded contact groups 306 are pushed vertically downward.

In this way, conventionally, the connector is formed by simply fitting the sets of contact group 306 which are formed by insert-molding, into the housing 303. Therefore, looseness occurs in the contact groups 306 in the longitudinal direction of the housing 303, so that the terminal alignment becomes poor in the longitudinal direction of the connector 300. When the terminal alignment is poor, it takes time in positioning of the press-fit portions of the contacts 301 to the through-holes formed in the printed circuit board 305. As a result, it is disadvantageous for assembling.

Also, since the contacts 301 are formed by insert-molding for every group, the cost is high in the manufacturing process.

In conjunction with the above description, a terminal assembly and an electric connector assembly using the same is disclosed in Japanese Patent No. 2,537,698 corresponding to English Patent Application Nos. 8922765.6 and 8922781.3 both filed on Oct. 10, 1989. In this reference, a terminal subassembly for the right angle connector has a plurality of terminals mutually arranged and is mounted on a substrate. Contact sections extend substantially in parallel in a first direction. Connection section extend into a second direction orthogonal to of the first direction and are connected with the substrate. Middle sections connects the contact sections and the connection sections, respectively. Each of a plurality of terminals has the contact section, the middle section and the connection section. A terminal lead frame contains the plurality of terminals. The terminal subassembly has a web having a substantially frame form and formed of dielectric material which is over-mold at the both edges of each of the middle sections of the terminal lead frame. One on the inner side of the plurality of middle sections of the terminal lead frame is bent for a signal path to be made long, and a portion over-mold by the web is made longer than an outer middle section.

Also, a connector is disclosed in Japanese Utility Model Registration No. 2,557,612. In this reference, the connector includes a plurality of contacts and an insulator. Each of the contacts of a substantially flat plate is composed of a press-fit section which is pressed into a through-hole of a substrate, a contact section which is detachably engaged with a contact of a counter connector, and a connection section which connects the contact section and the press-fit section. The contacts are planted in the insulator in a matrix manner in a connector pitch direction. The thickness direction of the press-fit section and the connection section is parallel to the connector pitch direction. A pressing section is provided at an upper portion of the press-fit section to have a thickness thicker than the connection section. The pressing section is composed of two pieces which are cut out and bent from the connection section. The two pieces extend in the pressing direction and are bent in directions opposite to each other with respect to the thickness direction.

SUMMARY OF THE INVENTION

Therefore, an object of the present invention is a connector in which the alignment of a plurality of contacts is improved.

Another object of the present invention is to provide a connector in which positioning between contacts and a printed circuit board can be easily made to increase in the assembling performance.

Still another object of the present invention is to provide a connector in which the manufacturing cost can be reduced.

In order to achieve an aspect of the present invention, a connector is composed of a plurality of contacts, a housing and a locator. The plurality of contacts are formed to have nearly L-shaped forms. One end of each of the plurality of contacts is inserted along a contact inserting direction and is fixed in the housing such that the other end of the contact is held along a direction orthogonal to the contact inserting direction. The locator has a plurality of slits in which the other ends of the plurality of contacts are inserted. Also, the locator has a plurality of through-holes consecutive to the plurality of slits such that the other ends of the plurality of contacts penetrate the plurality of through-holes. The locator is mounted on a surface of the housing on which the plurality of contacts are fixed, from a direction orthogonal to the contact inserting direction.

Here, each of the plurality of contacts may have a wide portion in the other end of each of the plurality of contacts. Thus, the locator includes protrusions formed in the plurality of through-holes such that the protrusions are engaged with the wide portions of the plurality of contacts at ends of the wide portions opposite to tips of the other ends. In this case, each of the protrusions may have a recess to be engaged with the opposite end of the wide portion. In addition, each of the plurality of slits may have a space formed to gradually widen toward an inside of the slit.

Also, the locator includes engaging protrusions extending in a direction orthogonal to the contact inserting direction and projecting toward the housing. Also, the housing may include stopping holes to be engaged with the engaging protrusions of the locator. In this case, each of the plurality of contacts may have a wide portion in the other end of each of the plurality of contacts. Also, the locator may include protrusions formed in the plurality of through-holes such that the protrusions are engaged with the wide portions of the plurality of contacts at ends of the wide portions opposite to tips of the other ends. In this case, each of the protrusions may have a recess for engaging the wide portion. In addition, each of the plurality of slits has a space formed to gradually widen toward an inside of the slit.

Also, the plurality of contacts may be grouped into contact groups, and the contacts of each group may be disposed in a predetermined interval on a same plane. Thus, each of the plurality of slits is provided for one of the contact groups. In this case, ones of the plurality of through-holes for each of the contact groups are formed in the slit in a line.

BRIEF DESCRIPTION OF THE DRAWINGS

FIGS. 11A and 11B are exploded views corresponding to FIG. 8 in the connector according to the embodiment of the present invention;

FIGS. 12A and 12B are exploded views corresponding to FIG. 9 in the connector according to the embodiment of the present invention;

DESCRIPTION OF THE PREFERRED EMBODIMENTS

Hereinafter, a connector of the present invention will be described below in detail with reference to the attached drawings.

Figure 1:
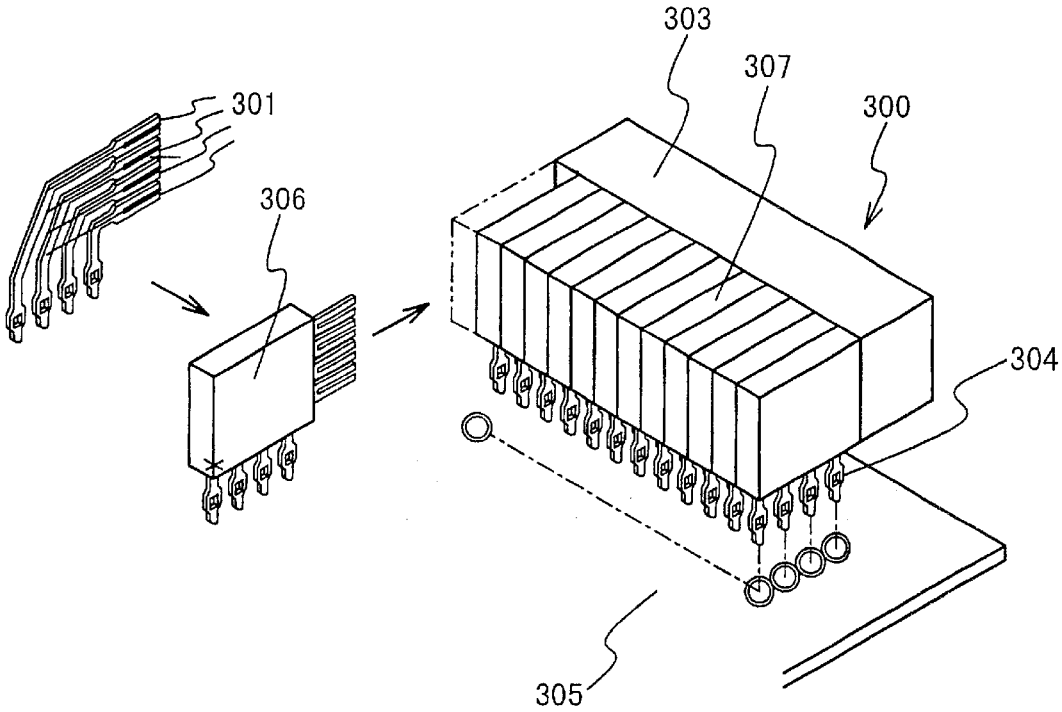
Fig. 1 PRIOR ART
FIG. 1 is a perspective exploded view showing an example of a conventional connector.
Figure 2:
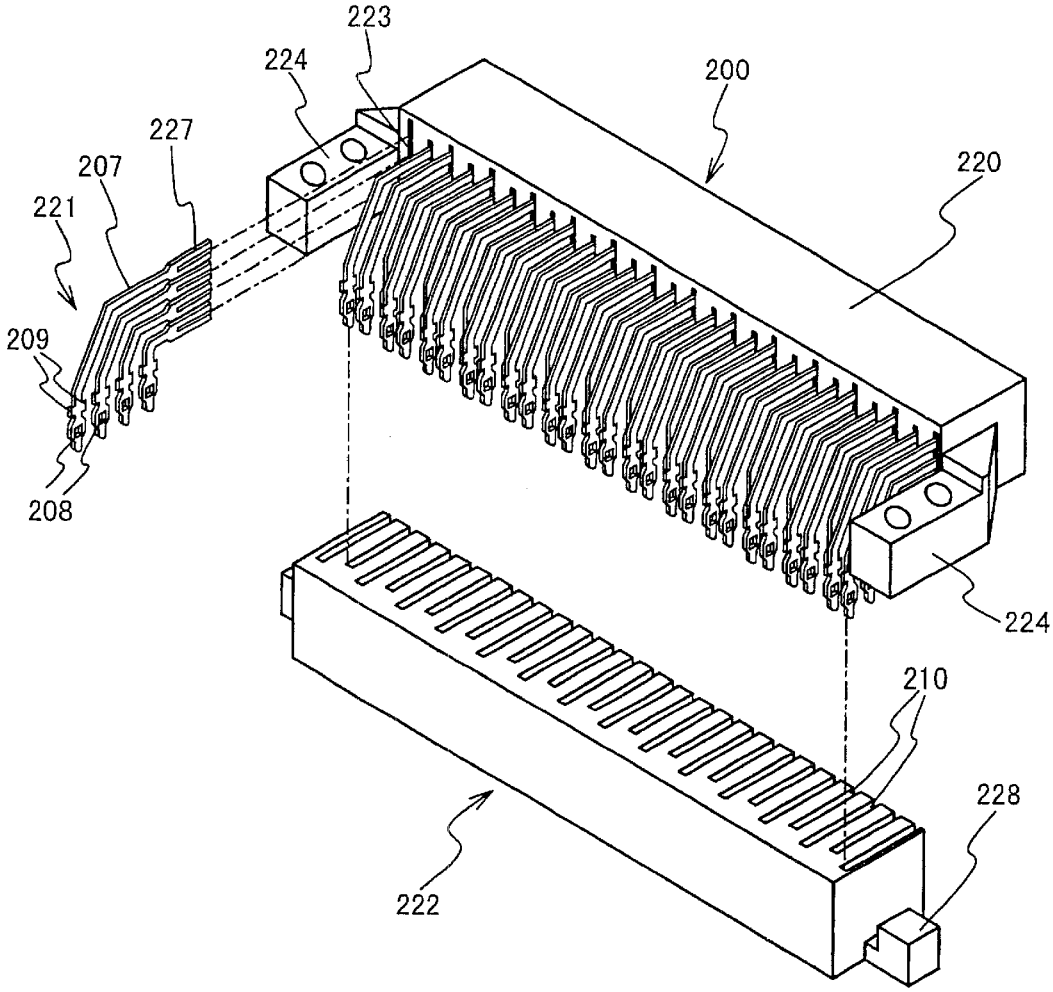
FIG. 2 is a perspective exploded view showing an embodiment of the present invention.
Figure 3:
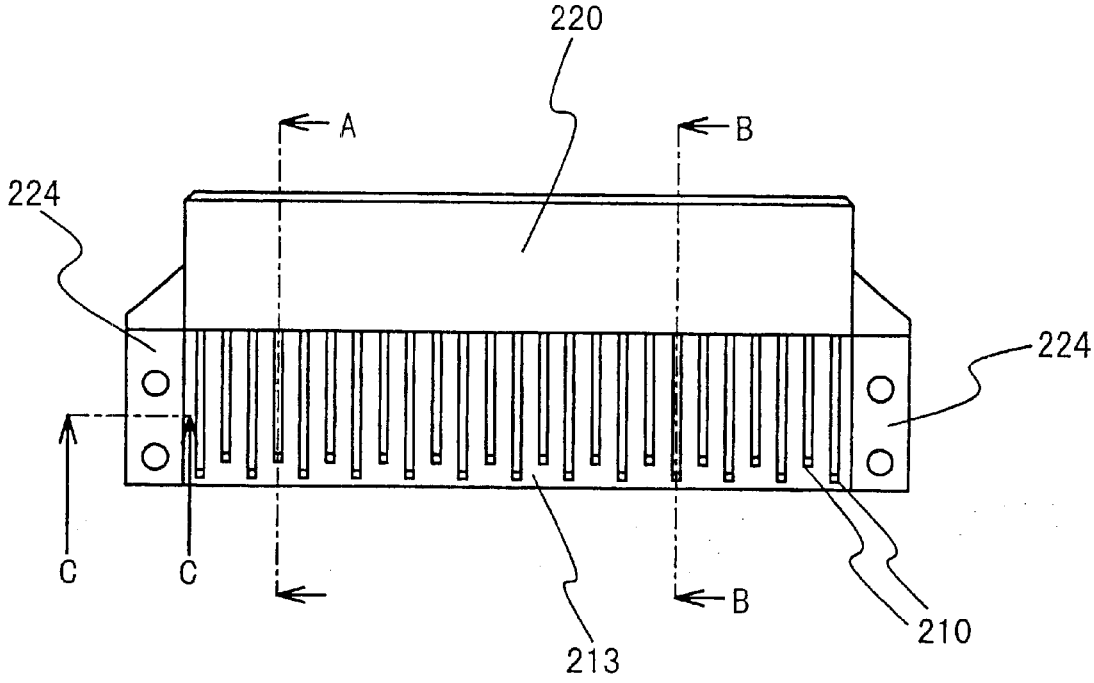
FIG. 3 is a plan showing the connector according to the embodiment of the present invention.
Figure 4:
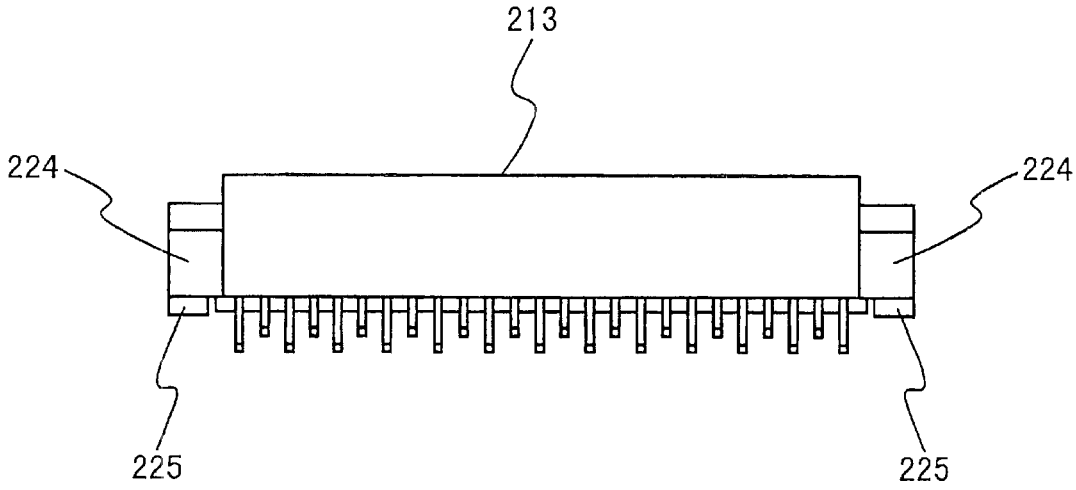
FIG. 4 is a front view showing the connector according to the embodiment of the present invention.
Figure 5:
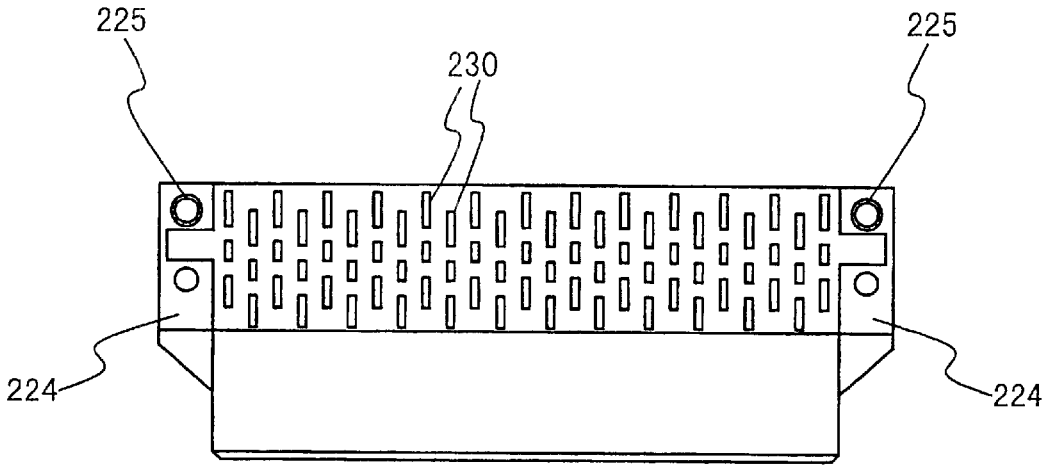
FIG. 5 is a bottom view showing the connector according to the embodiment of the present invention.
Figure 6:
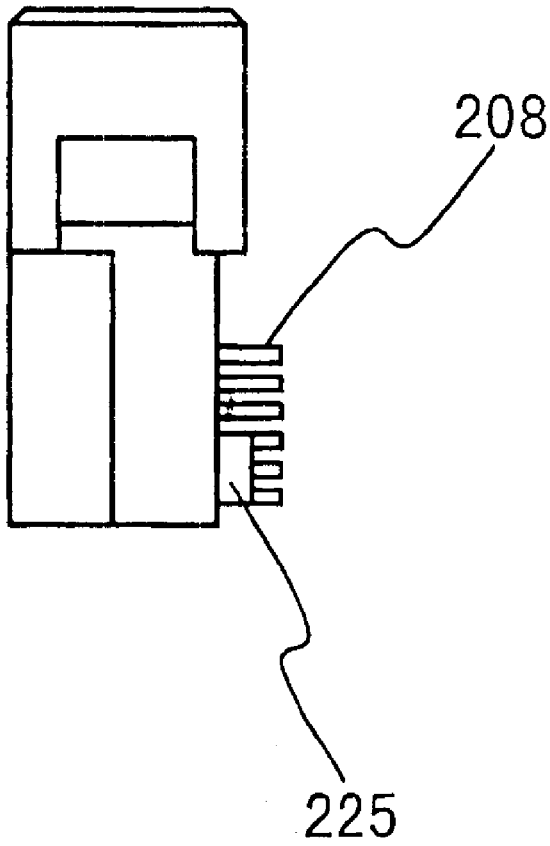
FIG. 6 is a side view showing the connector according to the embodiment of the present invention.

FIG. 2 is a perspective exploded view showing an embodiment of the present invention. Referring to FIG. 2, the connector 200 of the present invention is composed of plural contacts 221, a housing 220 and a locator 222. The plural contacts 221 are formed nearly in an L-shape. Junctions 227 formed at one end of each of these contacts 221 are inserted and fixed in the housing 220. Press-fit portions 208 formed at the other end of each of these contacts 221 are held along a direction orthogonal to the inserting direction of the contacts 221 into the housing 220. The locator 222 is mounted on a fixing plane of the housing 220 from a direction orthogonal to the inserting direction of the contacts 221. The locator 222 has plural slits 210 where the press-fit portions 208 of the contacts 221 are inserted. Also, the locator 222 has through-holes 230 extending from the slits 210 for the press-fit portions 208 of the contacts 221 to penetrate.

Figure 8:
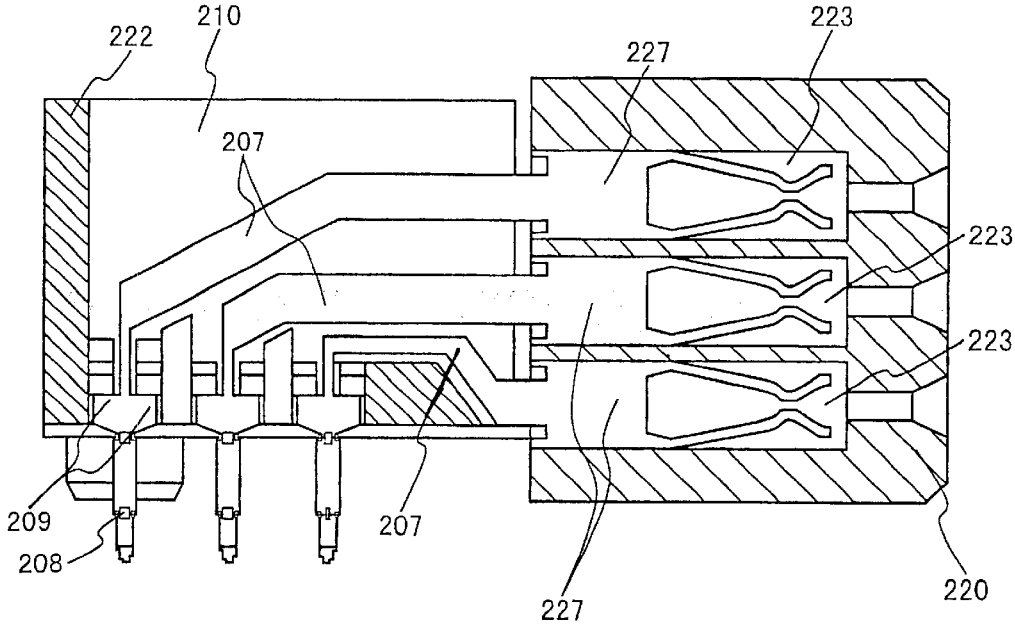
FIG. 8 is a sectional view along line A—A in FIG. 3 showing the connector according to the embodiment of the present invention.
Figure 9:
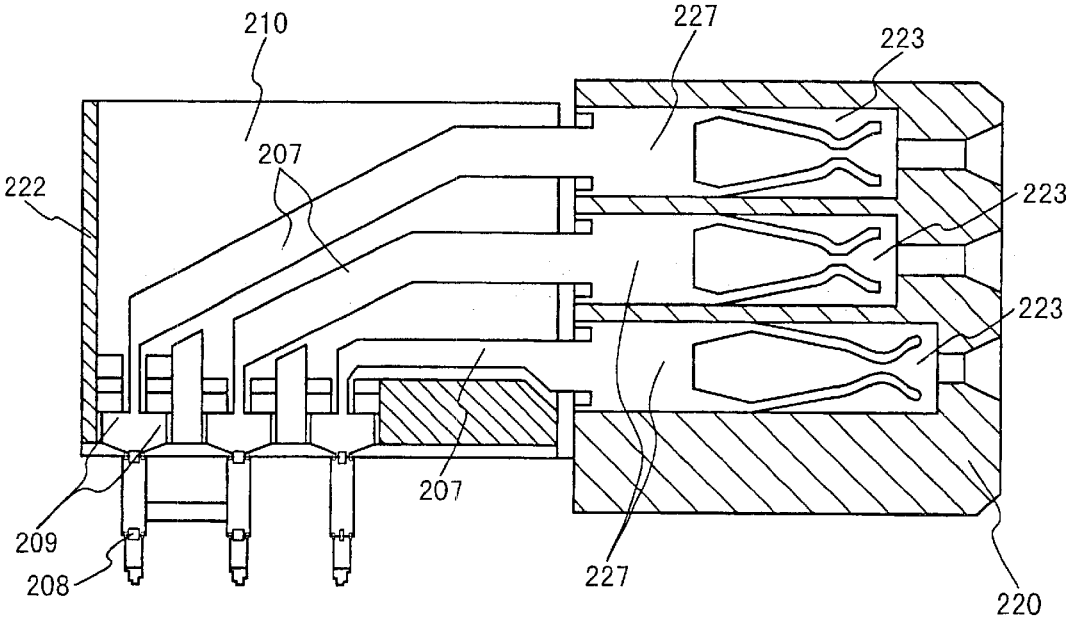
FIG. 9 is a sectional view along line B—B in FIG. 3 showing the connector according to the embodiment of the present invention.

More specifically, the contacts 221 are formed in a nearly L-shape by blanking a plate material of conductive material by use of a press. As specifically shown in FIG. 8 and FIG. 9, one end portion of the blanked plate is formed like a fork. The one end portion is bent and curved such that the leading ends may be set closer to form junction portions 227. The other end is the press-fit portion 208. Both of the junction portion 227 and the press-fit portion 208 are connected by a lead terminal portion 207 such that the junction portion 227 and the press-fit portion 208 are at right angle.

A contact group is formed of the plural contacts 221, three contacts 221 in this embodiment. The contacts 221 of each contact group are formed in a nearly similar shape. The contacts 221 are inserted and fixed in the housing 220 on a same plane. At this time, the larger one of the contacts 221 is accompanied by the next larger contact 221 at the inner side in a predetermined intervals, as seen in FIG. 8, FIG. 9, FIGS. 11A and 11B, and FIGS. 12A and 12B.

A wide portion 209 is formed in the connecting region of the press-fit portion 208 of each contact 221 and the lead terminal portion 207. The wide portion 209 is engaged with a protrusion 211 formed in the through-hole 230 as mentioned below.

In the housing, as shown in FIG. 8, FIG. 9, FIGS. 11A and 11B, and FIGS. 12A and 12B, contact holding holes 223 are formed vertically at predetermined intervals. The junction portions 227 of the contacts 221 of each contact group are inserted and fixed in the contact holding holes 223. These contact holding holes 223 are formed at a predetermined interval in the longitudinal direction of the housing 220 for each contact group.

Figures 7A, 7B:
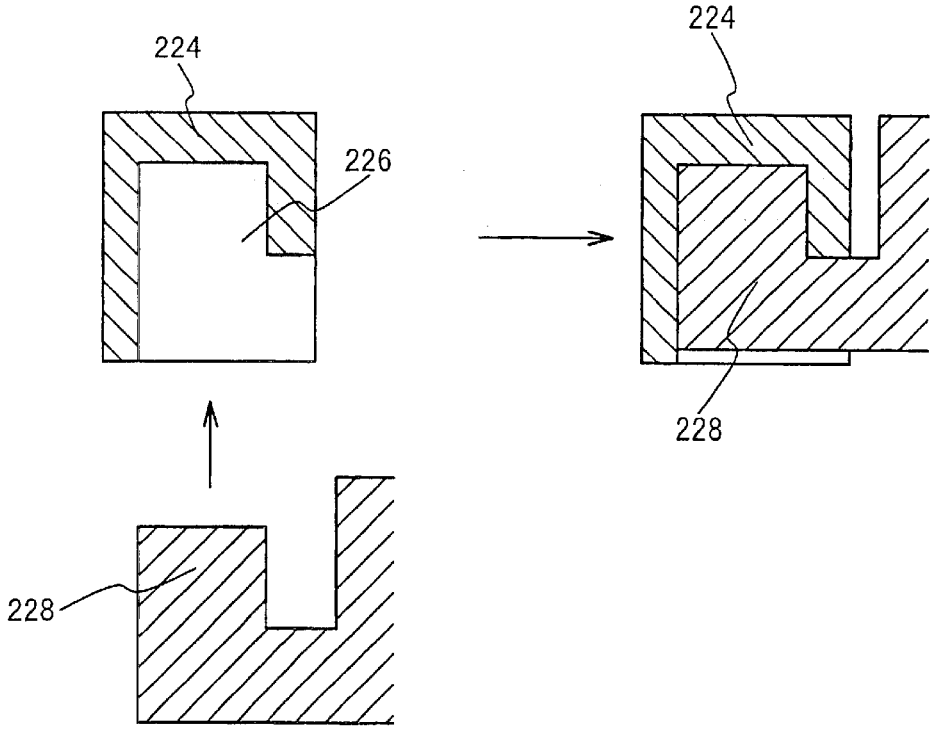
FIGS. 7A and 7B are sectional views along line C—C in FIG. 3 showing the connector according to the embodiment of the present invention.
Figure 13:
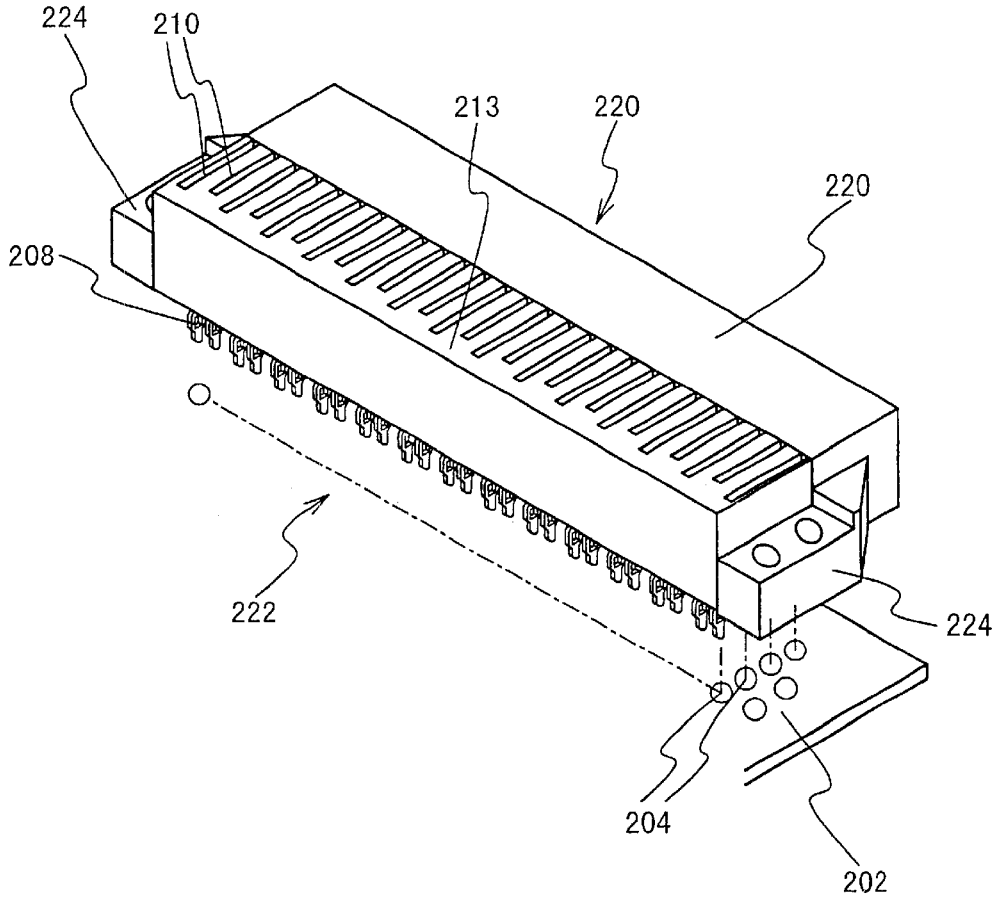
FIG. 13 is a perspective view for explaining the procedure of mounting the connector on a printed circuit board in the connector according to the embodiment of the present invention.

At both ends of the housing 220, arm portions 224 are formed to hold the fixing plane of the contacts 221 in the longitudinal direction as shown in FIG. 2 through FIG. 5. Also, at the lower side of these arm portions 224, that is, at the side of the contacts 221 where the leading ends of the press-fit portions 208 are positioned, bosses 225 (FIGS. 4–5) are formed for the connector 200 to be engaged with the printed circuit board 202 (FIG. 13). Further, as shown in FIG. 7, a stopping hole 226 is formed so as to be fitted with engaging protrusions 228 provided at both ends of the locator 222 to be described below.

The locator 222 is fitted from the lower side of the housing 220 so that its one side may contact with the side of the housing 220 in which the contacts 221 are inserted. The plural slits 210 formed in the locator 222 are formed at the same pitch as the pitch of the contact holding holds 223 formed in the housing 220 in the longitudinal direction of the housing 220. These slits 210 are formed to have an opening portion upward and at the contact surface side with the housing 220 as shown in FIG. 8, FIG. 9, FIGS. 11A and 11B, and FIGS. 12A and 12B. In the lower portion of the locator 222, the through-holes 230 are formed consecutive to the slits 210. These through-holes 230 are formed at three positions corresponding to the contacts 221 of the contact group.

Figure 10:
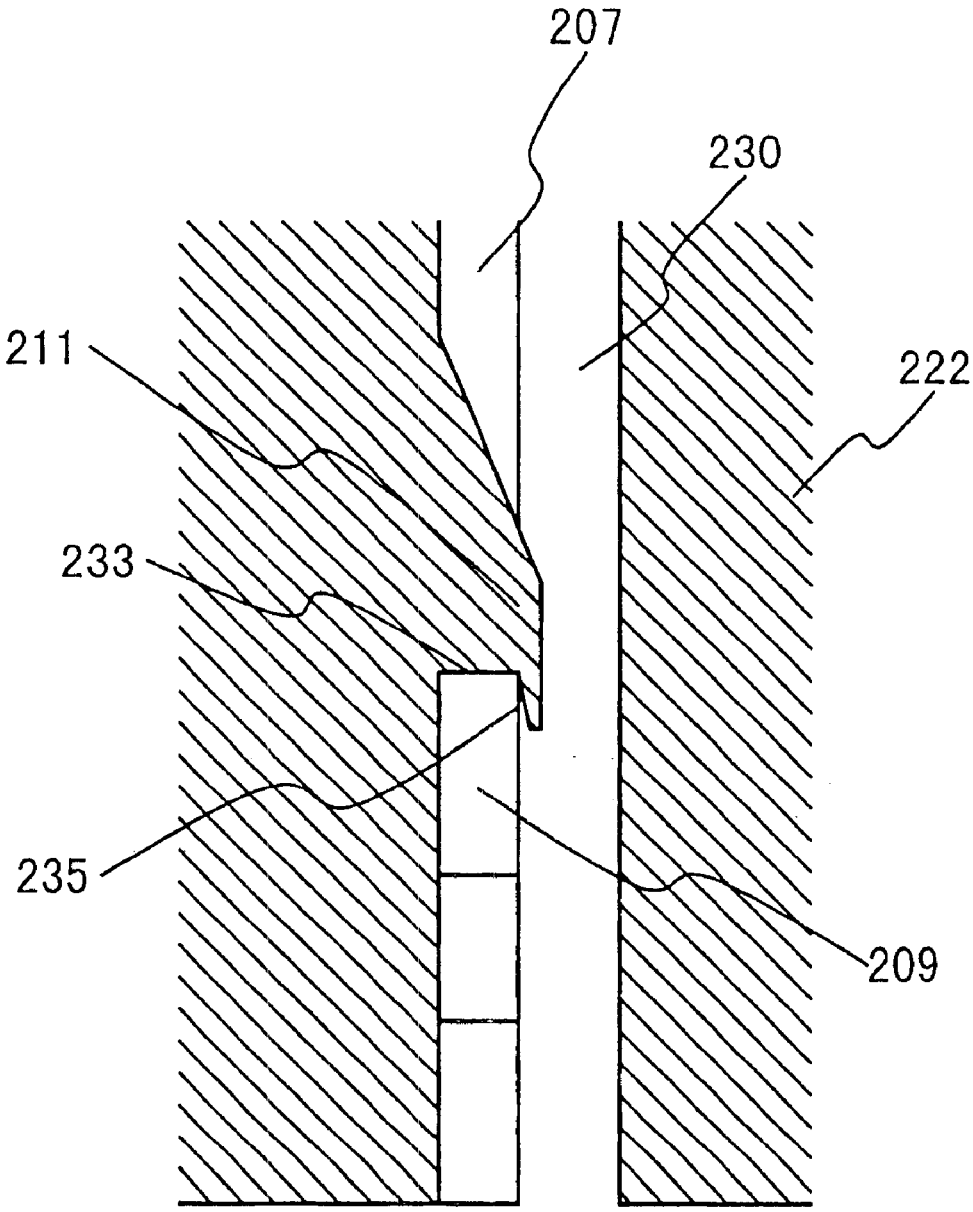
FIG. 10 is a magnified longitudinal sectional view of a through-hole portion in the connector according to the embodiment of the present invention.

In the end inner wall of each through-hole 230 at the slit 210 side, a tapered portion 232 is formed to widen gradually toward the inner side of the slit 210. At an intermediate position of the inner wall of each through-hole 230, a pair of protrusions 211 are formed at the slit 210 side to be engaged with both sides of the wide portion 209 which is formed to extend from the press-fit portion 208 of the contact 221 and the lead terminal portion 207, as shown specifically in FIG. 10 to FIGS. 12A and 12B. These protrusions have slope planes on the slit 210 side to form the tapered portion 232 widening gradually toward the inside of the slit. Further, the protrusion 211 has a recess 233 with which the wide portion 209 is engaged and fixed after the contact 221 is inserted, as shown in FIG. 10. The side wall of the recess 233 on the central side of the through-hole 230 has a tapered surface 235.

The connector 200 in the embodiment is assembled by press-fitting the contacts 221 into the housing 220, and then by fitting the locator 222 with the contacts 221 from the lower side of the press-fit portions 208 of the contacts 221. That is, the contacts 221 are first inserted into the slits 210 of the locator 222 gradually from beneath, that is, from the press-fit portion 208 side. At this time, the press-fit portions 208 are guided into the through-hole 230 by a tapered portion 236 of the dividers 231 between through-holes 230 at the slits 210. When the contacts 221 are further inserted, the engaging protrusions 228 at both ends of the locator 222 begin to be fitted into the stopping holes 226 formed in the lower part of the arm portions 224 of the housing 220.

Next, the wide portion 209 interferes with the tapered portion 232 on the upper portion of the protrusion 211 in the through hole 230 of the locator 222. Consequently, the entire lead terminal portions 207 are displaced in the plate thickness direction of the contacts 221, that is, in the height direction of the protrusions 211 according to the height of the slope 232. Further, when the press-fit portions 208 are inserted to the lower part of the protrusions 211, the wide portion 209 rides over the protrusions 211 by elastic deformation of the lead terminal portions 207. As a result, the wide portion 209 returns to the position before it is in contact with the tapered portion 232. When the lead terminal portions 207 are displaced in reverse direction of the inserting direction, the wide portion 209 is picked up by the tapered portion 235 beneath the protrusions 211, and is engaged with the recess 233.

In this engaging process, first the engaging protrusions 228 at both ends of the locator 222 begin to be engaged with the stopping holes 226 of the arm portions 224. Therefore, the wide portion 209 interferes with the protrusions 211 inside the slits 210. Even if a force is applied in the longitudinal direction of the locator 222, its reaction can be received at the engaging protrusions 228.

Thus assembled connector 200 can be mounted on the printed circuit board 202 as follows. That is, the leading ends of the press-fit portions 208 are positioned or provisionally press-fit into the through-holes 204 in the printed circuit board 202, and then the plane 213 of the locator 222 is pressed by means of a universal press or the like, as shown in FIG. 13.

In the connector 200 of the embodiment, since each contact 221 is restrained by the locator 222, the alignment of the press-fit portions 208 are improved outstandingly, so that it can be mounted on the printed circuit board 202 easily and securely.

Moreover, as the wide portion 209 is limited by the recess 233 of the protrusion 211, the press-fit portions 208 of the contacts 211 are restrained. Therefore, the alignment of the leading ends of the press-fit portions 208 is improved in both of a longitudinal direction and a vertical direction of the connector 200.

Accordingly, when the connector is mounted on the printed circuit board, the leading ends of the press-fit portions 208 can be easily press-fitted provisionally into the through-holes 204. In particular, in the connector of smaller size and higher density having the smaller diameter of the leading ends of the press-fit portions 208 and the through-holes 204 and the greater number of terminals than in the conventional connector, the effect is outstanding when press-fitting manually.

Still more, the alignment of the leading ends of the press-fit portions 208 is enhanced in both of the longitudinal direction and the vertical direction of the connector 200. Therefore, the connector 200 can be easily mounted on the printed circuit board 202 by pressing the upper plane 213 of the locator 222 with a universal press by using a simple tool. That is, without requiring any particular parts, structure or manufacturing method, the right-angle press-fit connector can be manufactured at a same low cost as a conventional connector formed by soldering.

It should be noted that the shapes and dimensions of the parts and members described in the embodiment are only examples, and may be changed in various forms depending on the design requirements or the like. For example, the projecting direction of the protrusions 211 in the slits 210 of the embodiment is a common direction in all the through-holes 230 in the plural slits 210. However, these protrusions 211 are protruded evenly from both side walls depending on the number of slits 210. In this case, even if the lead terminal portions 207 interfere with the protrusions 211 inside the slits 210 to cause force in the longitudinal direction of the locator 222, it is not necessary to receive the reaction by the protrusions 211 since the force is canceled inside the locator 222. As a result, the protrusions 211 and the arm portions 224 are not required. Therefore, stacking of the connector 200 becomes possible in the longitudinal direction, so that the mounting efficiency is enhanced.

As described above, according to the present invention, the alignment of other ends of the contacts can be improved significantly by restraining the contacts by the locator, and hence executes mounting on the printed circuit board easily and securely.

The wide portion is engaged with the recess of the protrusion, so that the other ends of the contacts are restrained. Therefore, the alignment of the leading ends of the other ends of the contacts can be improved in both of the longitudinal direction and vertical direction of the connector. As a result, when the connector is mounted on the printed circuit board, provisional press-fitting of the leading ends of other ends of the contacts and the through-holes of the printed circuit board can be made easy.

Since the alignment of the leading ends of the other ends of the contacts is improved in both of the longitudinal direction and the vertical direction in the connector, the connector can be easily mounted on the printed circuit board by pressing the upper plane of the connector with a universal press by using a simple tool. That is, without requiring any particular parts, structure or manufacturing method, the right-angle press-fit connector can be manufactured at a same low cost as a conventional connector formed by soldering.

What is claimed is:

1. A connector comprising:

a plurality of contacts formed to have nearly L-shaped forms;

a housing in which one end of each of said plurality of contacts is inserted along a contact inserting direction and is fixed such that the other end of said contact is held along a direction orthogonal to said contact inserting direction; and a locator having a plurality of slits in which the other ends of said plurality of contacts are inserted, wherein said locator is mounted on a surface of said housing on which said plurality of contacts are fixed, from a direction orthogonal to said contact inserting direction, wherein said locator has a plurality of through-holes corresponding to said plurality of slits such that the other ends of said plurality of contacts penetrate said plurality of through-holes, wherein each of said plurality of contacts has a wide portion at the other end, and wherein said locator comprises a narrowing protrusion in each of said through-holes, each said narrowing protrusion having a tapered face that laterally deflects said wide portion as said plurality of contacts penetrate said through-holes and each said protrusion having a recessed face opposite said tapered face into which said wide portion is seated after said wide portion has penetrated beyond said tapered face.

2. The connector of claim 1, wherein said recessed face comprises a lip that fits over the edge of said wide portion.

3. The connector of claim 1, wherein said locator includes engaging protrusions extending in a direction orthogonal to said contact inserting direction and projecting toward said housing, and said housing includes stopping holes to be engaged with said engaging protrusions of said locator.

* * * * *